US006547202B2

(12) United States Patent
Paton

(10) Patent No.: US 6,547,202 B2
(45) Date of Patent: Apr. 15, 2003

(54) FLOATING BOOKSTAND

(76) Inventor: Eric Ramsay Paton, 2460 Garland, Sylvan Lake, MI (US) 48320

( * ) Notice: Subject to any disclaimer, the term of this patent is extended or adjusted under 35 U.S.C. 154(b) by 0 days.

(21) Appl. No.: 09/681,856

(22) Filed: Jun. 15, 2001

(65) Prior Publication Data

US 2003/0042390 A1 Mar. 6, 2003

(51) Int. Cl.[7] ..... A47B 97/04; A47B 5/04
(52) U.S. Cl. ..... 248/453; 248/444.1; 248/441.1
(58) Field of Search ..... 248/453, 441.1, 248/444.1, 446, 447, 460, 462, 910; 441/81, 131

(56) References Cited

U.S. PATENT DOCUMENTS 2,528,990 A * 11/1950 Atwood ..... 248/451
2,834,149 A * 5/1958 Flahive et al. ..... 248/445
2,908,465 A * 10/1959 Lykes ..... 248/445
3,476,348 A * 11/1969 Rustad ..... 248/444.1
3,656,749 A * 4/1972 Reyes ..... 473/485
3,863,882 A * 2/1975 Hatcher ..... 248/453
4,036,465 A * 7/1977 Kellner ..... 248/463
4,248,255 A * 2/1981 Arrowsmith ..... 135/96
4,313,589 A * 2/1982 Vega ..... 248/558
4,358,866 A * 11/1982 Rhodes ..... 114/363
4,432,042 A * 2/1984 Zeller ..... 362/183
4,598,340 A * 7/1986 Dwosh et al. ..... 362/98
4,958,453 A * 9/1990 Mangler et al. ..... 40/352
5,025,353 A * 6/1991 Menaged ..... 362/98
5,037,056 A * 8/1991 Thompson ..... 248/441.1
5,161,766 A * 11/1992 Arima ..... 248/447
5,624,096 A * 4/1997 Haynes ..... 248/451
5,761,753 A * 6/1998 Talbert ..... 4/559
5,772,484 A * 6/1998 Silkorski ..... 441/81
5,855,329 A * 1/1999 Pagano ..... 248/451
5,884,888 A * 3/1999 Grimes, III et al. ..... 248/441.1
5,971,343 A * 10/1999 Marlak ..... 248/441.1
6,202,973 B1 * 3/2001 Navarin et al. ..... 248/444

* cited by examiner

*Primary Examiner*—Anita King
(74) *Attorney, Agent, or Firm*—Harness, Dickey & Pierce, P.L.C.

(57) ABSTRACT

A novel book stand arrangement capable of sustaining common reading material above the surface of water. An angled shelf capable of accommodating books, magazines, and folded newsprint is positioned at a height and angle optimal for users lounging and submersed within pools, spas, hot tubs, indoor jet tubs, or conventional residential bathtubs. The shelf is attached to a horizontal buoyant base and angled in such a way so that the weight of the reading material distributes the displacement evenly onto the base to promote stability and balance. The rear support arm may detach from the base and swivel flush onto the back of the shelf. The shelf may then swivel down and rest on the base to fold the unit flat for storage and transport. A clear plastic retainer is provided to hold bound material like paperbacks and hard/soft cover books in place against the shelf. The retainer slides down the front of the shelf to provide a transparent cavity for which the bound material can reside. While placed in this cavity they can remain open and stable on the shelf without the aid of the user. A clip light is also provided to aid users who wish to read in dimly light conditions. The clip light attaches on the upper edge of the shelf via a spring tension lever. The light is emitted from the end of a swivel arm capable of being positioned for maximum illumination of material. The spring tension lever may also serve as a page retainer for some materials to maintain stability and position.

17 Claims, 3 Drawing Sheets

FLOATING BOOKSTAND

BACKGROUND OF INVENTION

This invention relates to the art of perching books and other related reading material in a position most convenient for users to read and handle. More particularly the invention pertains to the user submersed in pools, spas, and other related soaking apparatus.

Bookstands of many shapes and sizes are commonly used by professors, cooks, lectures, students, or any other persons wishing to place reading material in a position most convenient for viewing. There are bookstands for users who sit, stand, or even lie in beds and loungers. All of these stands rely of some physically stable surface to position and accommodate the weight of the material.

Present practice for the leisure bathers who wish to read while soaking is to hold, usually with both hands, material up above the water surface at an angle and position most convenient to view. Often elbows are rested on pool or spa sides or material is stood on abdomens and chests depending on the position and degree of submersion. Maintaining these sometimes awkward positions often cause strain and discomfort resulting in frequent position changes and weary arms and hands.

To date, some attempts to solve the problem have been made. One attempt uses a mechanical bridge that can rest across the sides of conventional tubs and spas and provide a brace to rest an angled shelf upon which the reading material rests. This arrangement can only satisfy the user lounging in certain types of tubs and also restricts and confines them to a particular position and/or posture.

Thus there has long been a need for an arrangement to provide a bookstand for bathers. It is desired the device float the reading material on a stable angled surface so it may be positioned on the waters surface wherever it is best for the bather. Furthermore it is desired that the arrangement maintain stability on agitated pool or spa water surfaces. It must also provide a means of holding bound books open without user assistance, and provide adequate buoyancy for user hands to rest above the waters surface to keep them dry for turning pages. Additionally it is desirable for the device to accommodate reading lights that clip to book bounds and commonly found in book stores.

DETAILED DESCRIPTION

Figure 1:
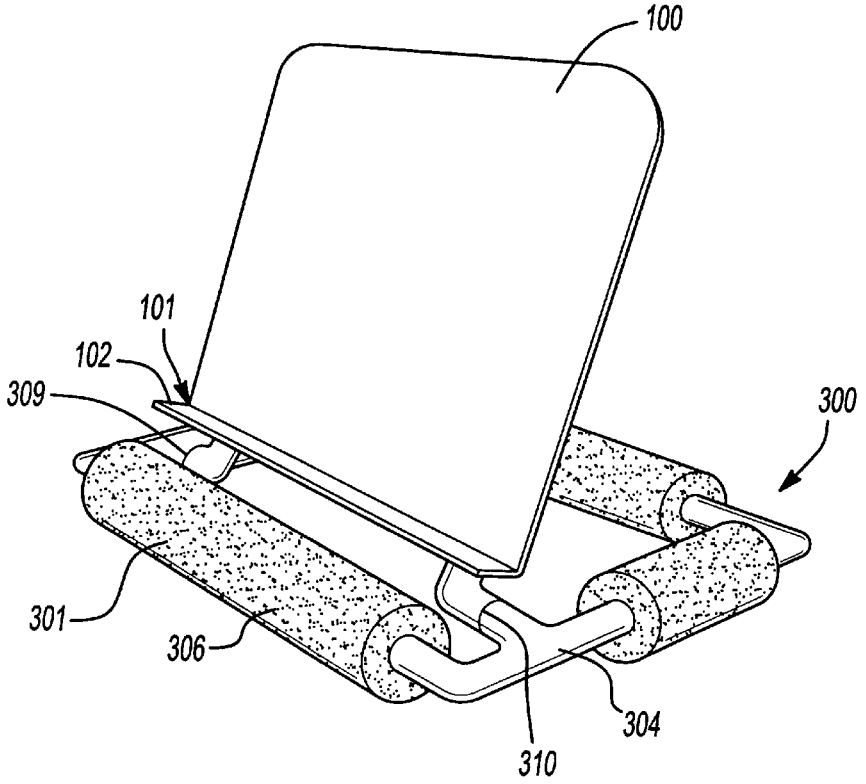
FIG. 1 is a front perspective view of an embodiment of the floating bookstand constructed in accordance with the teachings of the present invention.
Figure 2:
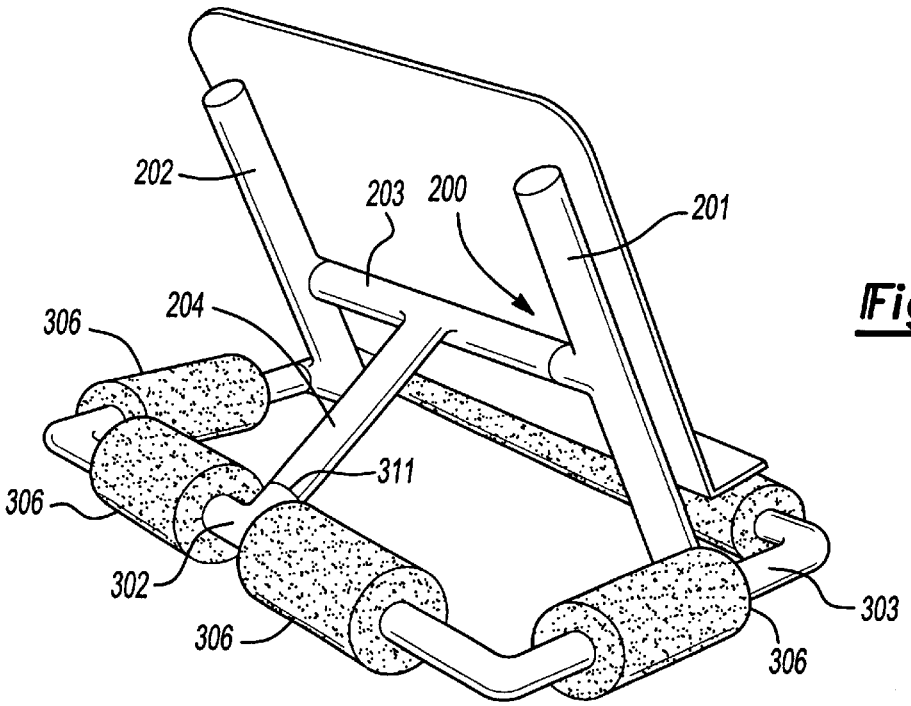
FIG. 2 is a rear perspective view of the floating bookstand depicted in FIG. 1.
Figure 3:
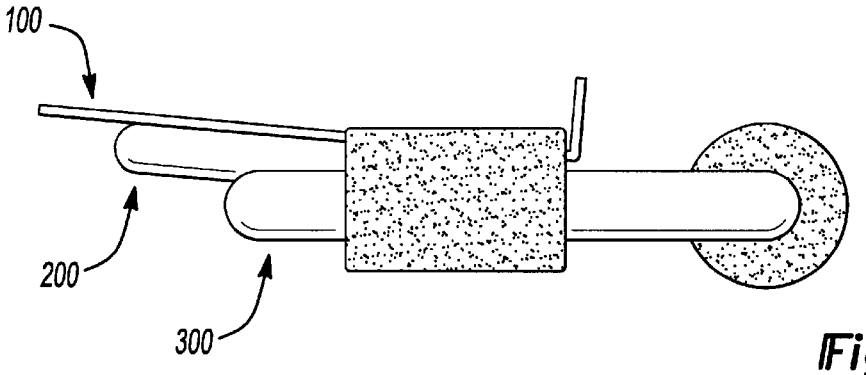
FIG. 3 is a side elevational view of the floating bookstand depicting the shelf in a stowed position.

The Floating Bookstand shown in FIGS. 1, 2, and 3 is comprised of a molded shelf (100) attached to an angled frame (200) that resides on a buoyant base (300). The shelf is comprised of a flat surface with a 90 degree bend (101) at the bottom to provide a weight bearing ledge (102) for which reading material may rest. The shelf is attached to a left and right rear angled shelf support members (201,202) of the angled frame (200). These members are connected by a single hingedly attached rear horizontal shelf support member (203) and attached to this member is a rear shelfsupport arm (204). Due to the hinges this support arm is able to swing 180 degrees relative to the rear surface of the shelf (100). The buoyant base (300) consists of a horizontal front base unit member (301), a horizontal rear base unit member (302), and horizontal left and right side base unit members (303,304). All are connected at their ends to form a rectangle. Surrounding each base member is closed cell foam (306) to provide the required displacement when placed into water. The angled frame (200) attaches to the buoyant base (300) in three places. Two of the connections (309,310) are hingedly attached to the side base unit members (303,304). The third attachment (311) is made between the center of the rear base unit member (304) and the rear shelf support arm (204). This third connection point is a non-permanent socket allowing the arm to be removed from its connection point and folded under flush with the rear of the shelf (100). This allows the shelf (100) and angled frame (200) to collapse onto the buoyant base (300) to form a flush profile as shown in FIG. 3.

Figure 4:
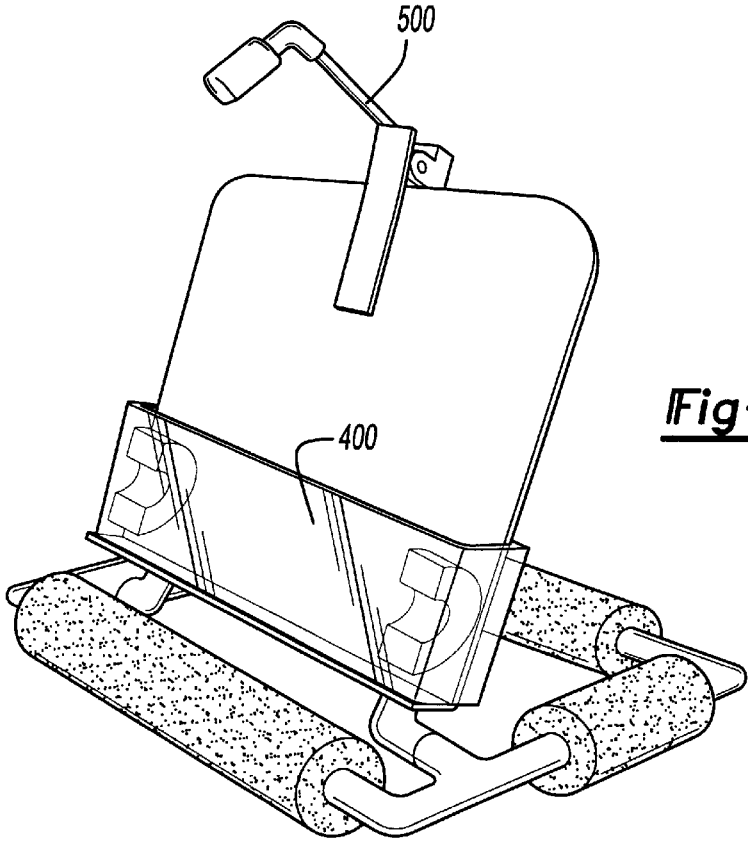
FIG. 4 is front perspective view of the floating bookstand including a spring clip battery pack and a retainer.
Figure 5:
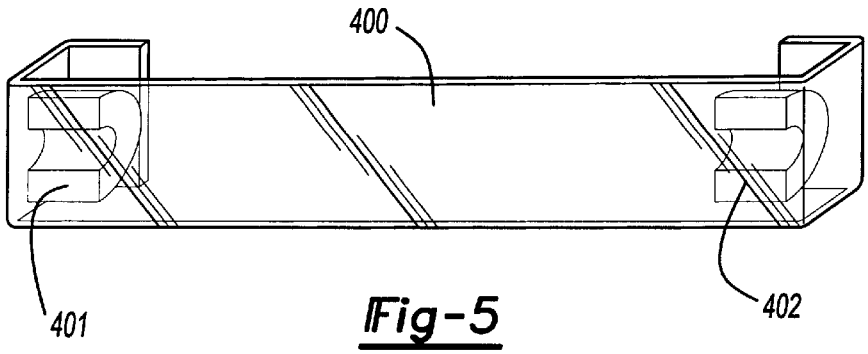
FIG. 5 is a perspective view of the retainer of the present invention.

The device may also be equipped with two useful accessories, a retainer (400), and a clip light (500). Each is shown while in use with the floating bookstand in FIG. 4. The retainer (400), shown in FIG. 5, is made from clear plastic sheet, formed into a shape that is capable of sliding down over the shelf (100). At either end of the retainer are foam spacers (401,402) to hold the retainer away from the surface of the shelf (100) forming a cavity for which books can be placed. The cavity prevents books with strong bindings from closing and/or falling from the ledge (102). Since the retainer (400) is made of clear plastic it can easily be read through while it sustains the book on the shelf. It may also be slid up/down the shelf (100) to optimize the area where the cavity is best applied to the book. The retainer (400) width is dimensioned such that it rests on the ledge (102) when forced to the bottom of the shelf (100) and is incapable of falling off.

Figure 6:
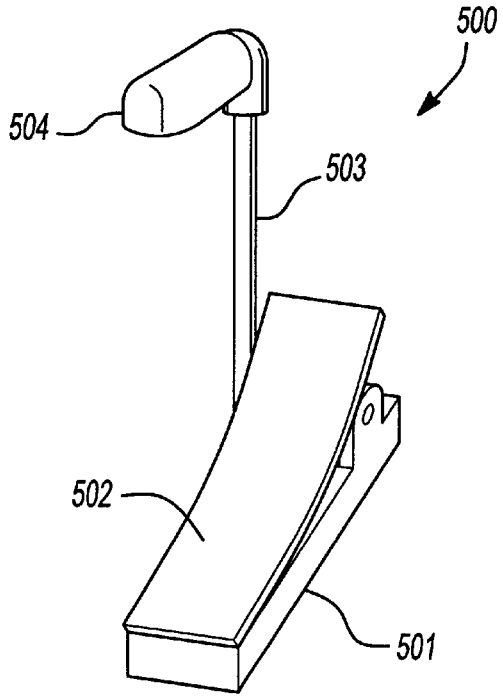
FIG. 6 is a perspective view of the spring clip batter pack of the present invention.

The light clip (500), shown in FIG. 6, is provided for illuminating reading material in dimly light or darkened user conditions. It is comprised of a base (501) that retains batteries and a spring clip (502) to allow the assembly to easily reside onto the top edge of the shelf (100). Once mounted the swivel arm (503) and lamp hood (504) can be adjusted to optimize the illumination onto the reading material. The spring clip (502) may also be clipped over material and the top edge of the shelf (100) simultaneously to act as a page holder.

Figure 7:
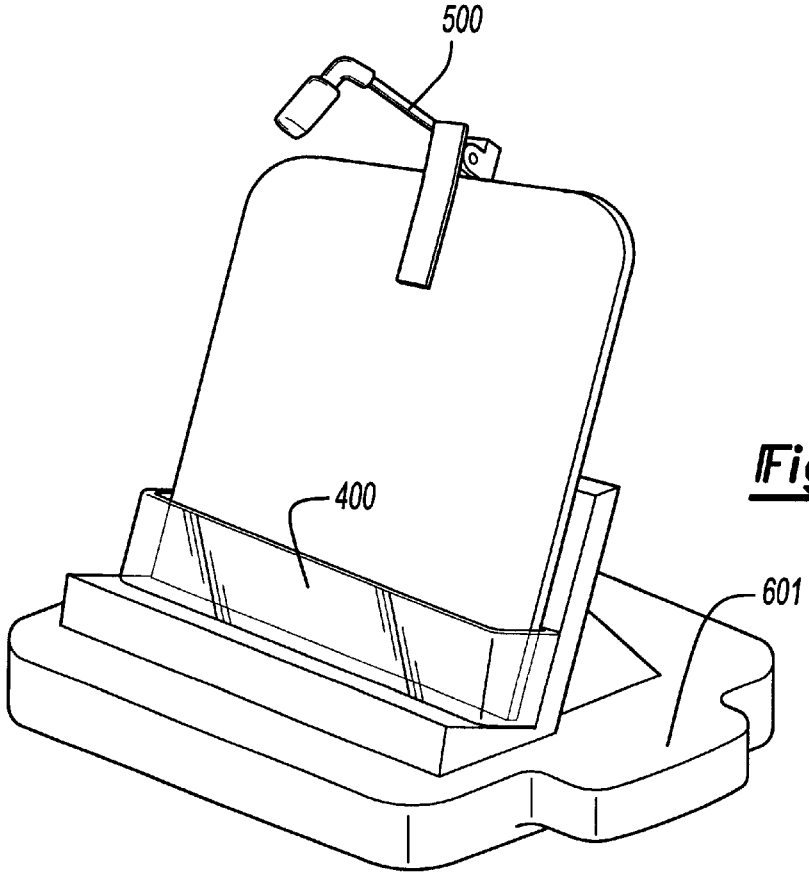
FIG. 7 is a front perspective view of an alternate embodiment floating bookstand.

The floating bookstand may also be implemented using an injected molded plastic design as shown in FIG. 7. The unit would be hollow and water tight to provide adequate buoyancy. All the same features described above would be provided with the exception of the ability to fold flat. However two additional features of this design are the hand rest extensions (601) on either side of the and potentially cup holders in future designs. The hand rest extensions are provided for the comfortable placement of hands out of the water to prevent dampening material while page turning.

What is claimed is:

1. An arrangement for sustaining reading material above the surface of Water at a height and angle optimal for users lounging and submersed in water, the arrangement comprising:

a shelf having a flat angled surface and a bottom ledge substantially perpendicular to said flat angled surface;

a frame including left and right shelf support members coupled to said shelf, wherein each of said shelf support members is attached to a horizontal shelf support member; and a base unit having a buoyant frame including a front base unit member, left and right said side base unit members, and a rear base unit member, and wherein said horizontal shelf support member is coupled to said base unit wherein each of said left and right shelf support members is hingedly attached to the respective left and right side base unit member.

2. The arrangement defined in claim 1 wherein said horizontal shelf support member is hingedly coupled to each of said shelf support members.

3. The arrangement defined in claim 1 wherein said horizontal shelf support member is detachably attached to said base unit.

4. The arrangement defined in claim 1 further including a spring clip battery pack having a rotatable illuminating bulb at one end, wherein said spring clip battery pack is attachable to said shelf and wherein said bulb is selectively positionable by rotating a swing arm coupled to said shelf.

5. The arrangement defined in claim 1 further including a translucent retainer shaped to slide down said shelf and reside on said ledge forming a cavity.

6. An arrangement for sustaining reading material above the surface of water at a height and angle optimal for users lounging and submersed in water, the arrangement comprising:

a shelf having a surface upon which said reading material may be placed, said shelf having a flat angled surface with a bottom ledge substantially perpendicular to said flat angled surface for which material may rest, wherein said shelf is attached to a rear shelf support angled from horizontal that adheres with said shelf, wherein said shelf and said rear shelf support attach to a base and wherein said base includes left and right base constructs and front and rear base constructs to form a three dimensional buoyant shell, said arrangement further including a translucent retainer shaped to slide down said shelf and reside on said ledge forming a cavity.

7. A floating bookstand for supporting reading material above the surface of water at a height and angle suitable for users lounging in water, the floating bookstand comprising:

a buoyant base having a substantially hollow shell wherein said shell is substantially water tight to provide sufficient buoyancy to support said reading material above said water surface, wherein said buoyant base includes an upper surface having a pair of hand rest portions adapted for supporting the hands of a user above the surface of the water; and a shelf coupled to and protruding from said upper surface, wherein said shelf includes a substantially planar back panel and a ledge extending substantially orthogonally from said back panel, wherein said back panel is positioned to support the reading material at an angle suitable for reading.

8. The floating bookstand of claim 7 further including a shelf support for coupling said shelf to said base.

9. The floating bookstand of claim 8 wherein said shelf support is integrally formed with said base such that said shelf support forms a portion of said shell protruding from said upper portion of said base.

10. The floating bookstand of claim 9 wherein said ledge of said shelf is integrally formed with said base.

11. The floating bookstand of claim 7 wherein said hollow shell defines a cavity extending beneath said shelf.

12. A floating bookstand for supporting reading material above the surface of water at a height and angle suitable for users lounging in water, the floating bookstand comprising:

a substantially hollow buoyant base including an upper surface, an opposite lower surface and a wall extending about the perimeter of said base; said base further including a support extending from said upper surface;

a shelf coupled to said support wherein said shelf is positioned to support reading material above the water at an angle suitable for reading.

13. The floating bookstand of claim 12 wherein said shelf includes a substantially planar back panel and a ledge extending substantially orthogonally from said back panel.

14. The floating bookstand of claim 13 wherein said base further includes an integrally formed hand rest.

15. The floating bookstand of claim 14 further including a translucent retainer shaped to slide down said shelf and reside on said ledge forming a cavity.

16. The floating bookstand of claim 12 wherein said base is substantially rectangularly shaped.

17. The floating bookstand of claim 12 wherein said ledge is integrally formed with said base.

* * * * *